US007626593B2

(12) United States Patent
Eom et al.

(10) Patent No.: US 7,626,593 B2
(45) **Date of Patent: *Dec. 1, 2009**

(54) APPARATUS AND METHOD FOR DATA TRANSMISSION USING BIT DECREASE AND BIT RESTORATION, AND APPARATUS AND METHOD FOR DRIVING IMAGE DISPLAY DEVICE USING THE SAME

(75) Inventors: Sang Yong Eom, Gangwon-Do (KR); Young Nam Lee, Seoul (KR)

(73) Assignee: LG Display Co., Ltd, Seoul (KR)

( * ) Notice: Subject to any disclaimer, the term of this patent is extended or adjusted under 35 U.S.C. 154(b) by 579 days.

This patent is subject to a terminal disclaimer.

(21) Appl. No.: 11/372,072

(22) Filed: Mar. 10, 2006

(65) Prior Publication Data

US 2007/0115238 A1 May 24, 2007

(30) Foreign Application Priority Data

Nov. 21, 2005 (KR) ..... 10-2005-0111225

(51) Int. Cl.
*G09G 5/02* (2006.01)

(52) U.S. Cl. ..... 345/600; 345/204; 345/213; 345/690

(58) Field of Classification Search ..... 375/260
See application file for complete search history.

(56) References Cited

U.S. PATENT DOCUMENTS

| | | | | |
|---|---|---|---|---|
| 6,310,564 | B1 * | 10/2001 | Fujimoto | 341/55 |
| 6,369,825 | B1 * | 4/2002 | Nakano | 345/562 |
| 2004/0179031 | A1 * | 9/2004 | Ando | 345/698 |
| 2005/0062764 | A1 * | 3/2005 | Park et al. | 345/690 |
| 2005/0099381 | A1 | 5/2005 | Park | |
| 2005/0140619 | A1 | 6/2005 | Hong | |
| 2005/0163207 | A1 * | 7/2005 | Buckwalter et al. | 375/229 |
| 2005/0188181 | A1 * | 8/2005 | Mar | 712/220 |

FOREIGN PATENT DOCUMENTS

| | | |
|---|---|---|
| GB | 2 409 096 | 6/2006 |
| JP | 09-258686 | 10/1997 |

* cited by examiner

*Primary Examiner*—Alexander Eisen
*Assistant Examiner*—Matthew Yeung
(74) *Attorney, Agent, or Firm*—Holland & Knight LLP

(57) ABSTRACT

An apparatus for transmitting an image data within a display device includes a data converter converting an N-bit data, N is a positive integer, into an (N−1)-bit data and concurrently generating a restoring signal; and a data restorer restoring the (N−1)-bit data to the N-bit data in accordance with a value of the restoring signal.

8 Claims, 5 Drawing Sheets

APPARATUS AND METHOD FOR DATA TRANSMISSION USING BIT DECREASE AND BIT RESTORATION, AND APPARATUS AND METHOD FOR DRIVING IMAGE DISPLAY DEVICE USING THE SAME

This application claims the benefit of the Korean Patent Application No. 2005-111225, filed on Nov. 21, 2005, which is hereby incorporated by reference as if fully set forth herein.

BACKGROUND OF THE INVENTION

1. Field of the Invention

The present invention relates to a display device, more particularly to an apparatus and method for data transmission, and an apparatus and method for driving an image display device using the same.

2. Discussion of the Related Art

Recently, various flat panel displays have been developed that are lighter and less bulky than cathode ray tubes. Examples of such flat panel displays include a liquid crystal display (LCD), a field emission display (FED), a plasma display panel (PDP), and a light emitting display (LED). An LCD displays an image by controlling the light transmittance of liquid crystal cells in accordance with a video signal. In an active matrix type LCD, a switching element is provided in each liquid crystal cell. The active matrix type LCD typically includes a thin film transistor (TFT) as the switching element.

FIG. 1 shows a schematic diagram of an apparatus for driving an LCD according to the related art. Referring to FIG. 1, the related art apparatus for driving an LCD includes an image display unit 2 including liquid crystal cells formed in each pixel region defined by crossings of first to n-th gate lines GL1 to GLn with first to m-th data lines DL1 to DLm, a data driver 4 supplying analog video signals to the data lines DL1 to DLm, a gate driver 6 supplying scan pulses to the gate lines GL1 to GLn, and a timing controller 8 aligning externally provided input Data to supply the aligned data to the data driver 4, generating data control signals DCS to control the data driver 4, and generating gate control signals GCS to control the gate driver 6.

The image display unit 2 includes a transistor array substrate (not shown), a color filter array substrate (not shown), a spacer (not shown), and a liquid crystal (not shown). The transistor array substrate and the color filter array substrate face and are bonded to each other. The spacer maintains a uniform cell gap between the two substrates. The liquid crystal is filled in the cell gap area maintained by the spacer.

The image display unit 2 includes TFTs formed in the pixel regions defined by crossings of the gate lines GL1 to GLn and the data lines DL1 to DLm. The TFTs are electrically connected to the liquid crystal cells. The TFTs supply analog video signals from the data lines DL1 to DLm to the liquid crystal cells in response to the scan pulses from the gate lines GL1 to GLn.

A liquid crystal cell includes common electrodes and pixel electrodes connected to the thin film transistor and facing each other, and a liquid crystal interposed between the common electrodes and the pixel electrodes. Thus, the liquid crystal cell is equivalent to a liquid crystal capacitor Clc. The liquid crystal cell also includes a storage capacitor Cst connected to a previous gate line to maintain the analog video signals filled in the liquid crystal capacitor Clc until the next analog video signal is charged in the liquid crystal capacitor Clc.

The timing controller 8 aligns the externally provided Data input data in a format suitable for properly driving of the image display unit 2. The timing controller 8 supplies the aligned RGB data to the data driver 4. Also, the timing controller 8 generates the data control signals DCS and the gate control signals GCS using a main clock MCLK, a data enable signal DE, and horizontal and vertical synchronizing signals Hsync and Vsync, which are externally provided to control a driving timing of the data driver 4 and the gate driver 6.

The gate driver 6 includes a shift register (not shown) that sequentially generates scan pulses, for example, gate high pulses in response to a gate start pulse and a gate shift clock generated as gate control signals GCS from the timing controller 8. The gate driver 6 sequentially supplies the gate high pulses to the gate lines GL of the image display unit 2 to turn on the TFT connected to the gate lines GL.

The data driver 4 converts the aligned RGB data from the timing controller 8 into analog video signals in response to the data control signals DCS supplied from the timing controller 8. During each horizontal period, the data driver 4 supplies to the data lines DL1 to DLm the analog video signals corresponding to one horizontal line when the scan pulses are supplied into the gate lines GL1 to GLn. For example, the data driver 4 selects a gamma voltage having a predetermined level depending on a gray level value of the aligned RGB data and supplies the selected gamma voltage to the data lines DL1 to DLm. Then, the data driver 4 inverts a polarity of the analog video signals supplied to the data lines DL in response to a polarity control signal.

FIG. 2 is a schematic diagram illustrating a data transmission bus between a timing controller and a data driver in the related art apparatus of FIG. 1. The timing controller 8 includes a control signal generator 22 generating the control signals DCS and GCS, and a data aligner 24 aligning the source Data and supplying the Data aligned data to the data driver 4. The control signal generator 22 generates the gate control signals GCS (GSC, GSP and GOE) and the data control signals DCS (SSC, SSP, SOE and POL) using the main clock MCLK, the data enable signal DE, and the horizontal and vertical synchronizing signals Hsync and Vsync, which are externally provided. The gate control signals GCS are supplied to the gate driver 6 through respective transmission lines included in a gate control signal bus (not shown). The data control signals DCS are supplied to the data driver 4 through respective transmission lines included in a data control signal bus 12.

The data aligner 24 aligns the externally provided input source Data in a manner suitable for a bus transmission and synchronizes the aligned RGB data with a source shift clock SSC signal to supply the synchronized data to the data driver 4. For example, the data aligner 24 supplies the aligned RGB data to the data driver 4 through red, green and blue data buses 14, 16, and 18 as shown in Table 1. If each of the aligned RGB data is a 6-bit data, each of the data buses 14, 16 and 18 includes six data transmission lines to transfer the 6-bit data. Thus, the number of the data transmission lines becomes 18.

TABLE 1

| | Bit | | | | | |
|---|---|---|---|---|---|---|
| Grey level | D5 | D4 | D3 | D2 | D1 | D0 |
| 0 | 0 | 0 | 0 | 0 | 0 | 0 |
| 1 | 0 | 0 | 0 | 0 | 0 | 1 |
| 2 | 0 | 0 | 0 | 0 | 1 | 0 |
| 3 | 0 | 0 | 0 | 0 | 1 | 1 |
| . | . | . | . | . | . | . |
| . | . | . | . | . | . | . |
| . | . | . | . | . | . | . |
| 63 | 1 | 1 | 1 | 1 | 1 | 1 |

In Table 1, D0~D5 represent one of R, G, and B data values.

The timing controller 8 supplies data corresponding to one pixel (for example, 18 bits of respective 6 bits of R, G, and B) to the data driver 4 using eighteen data transmission lines from the three data buses 14, 16, and 18. However, if the data corresponding to one pixel are supplied from the timing controller 8 to the data driver 4, electromagnetic interference seriously occurs due to transition of the data. For example, if the current pixel data have a bit value of "0" and the next pixel data have a bit value of "1", a transition occurs in all the bits and causes high electromagnetic interference. Particularly, if resolution and size of the image display unit increase, electromagnetic interference is more severe.

SUMMARY OF THE INVENTION

Accordingly, the present invention is directed to an apparatus and method for data transmission and an apparatus and method for driving an image display device using the same, which substantially obviate one or more problems due to limitations and disadvantages of the related art.

An object of the present invention is to provide an apparatus and method for data transmission and an apparatus and method for driving an image display device using the same, in which data transitions are minimized during data transmission within the display device.

An object of the present invention is to provide an apparatus and method for data transmission and an apparatus and method for driving an image display device using the same, in which the image display device generates a reduced electromagnetic interference.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for transmitting an image data within a display device includes a data converter converting an N-bit data, wherein N is a positive integer, into an (N−1)-bit data and concurrently generating a restoring signal; and a data restorer restoring the (N−1)-bit data to the N-bit data in accordance with a value of the restoring signal.

In another aspect, an apparatus for driving an image display device includes an image display unit including pixel cells in each pixel region defined by crossings of a plurality of gate lines with a plurality of data lines; a timing controller converting an externally provided N-bit data, wherein N is a positive integer, into an (N−1)-bit data and concurrently generating a restoring signal for restoring the (N−1)-bit data to the N-bit data; a gate driver supplying scan pulses to the gate lines under the control of the timing controller; and a data driver restoring the (N−1)-bit data to the N-bit data in accordance with a logic level of the restoring signal, and converting the restored N-bit data into analog video signals under the control of the timing controller to supply the analog video signals to the data lines.

In still another aspect, a method for transmitting an image data within a display device includes converting an N-bit data, wherein N is a positive integer, into an (N−1)-bit data and concurrently generating a restoring signal for restoring the (N−1)-bit data to the N-bit data; and restoring the (N−1)-bit data to the N-bit data in accordance with the restoring signal.

In further still another aspect, in a method for driving an image display device, which includes an image display unit including pixel cells in each pixel region defined by crossings of a plurality of gate lines with a plurality of data lines, the method includes converting an externally provided N-bit data, N is a positive integer, into an (N−1)-bit data and concurrently generating a restoring signal for restoring the (N−1)-bit data to the N-bit data; restoring the (N−1)-bit data to the N-bit data in response to the restoring signal; supplying scan pulses to the gate lines; and converting the restored data into analog video signals to synchronize with the scan pulses and supplying the analog video signals to the data lines.

In yet a further aspect, an apparatus for transmitting an image data within a display device includes a data converter converting an N-bit data, wherein N is a positive integer, into an (N−1)-bit data and concurrently generating a restoring signal; and a data restorer restoring the (N−1)-bit data to the N-bit data in accordance with a value of the restoring signal, wherein the N-bit data includes first N-bit data having a gray level value greater than half the highest N-bit gray level value, and wherein the data converter includes first (N−1)-bit data including (N−1) inverted bits from the first N-bit data excluding the most significant bit of the first N-bit data, and the restoring signal corresponding to the first (N−1)-bit data having a first logic level.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
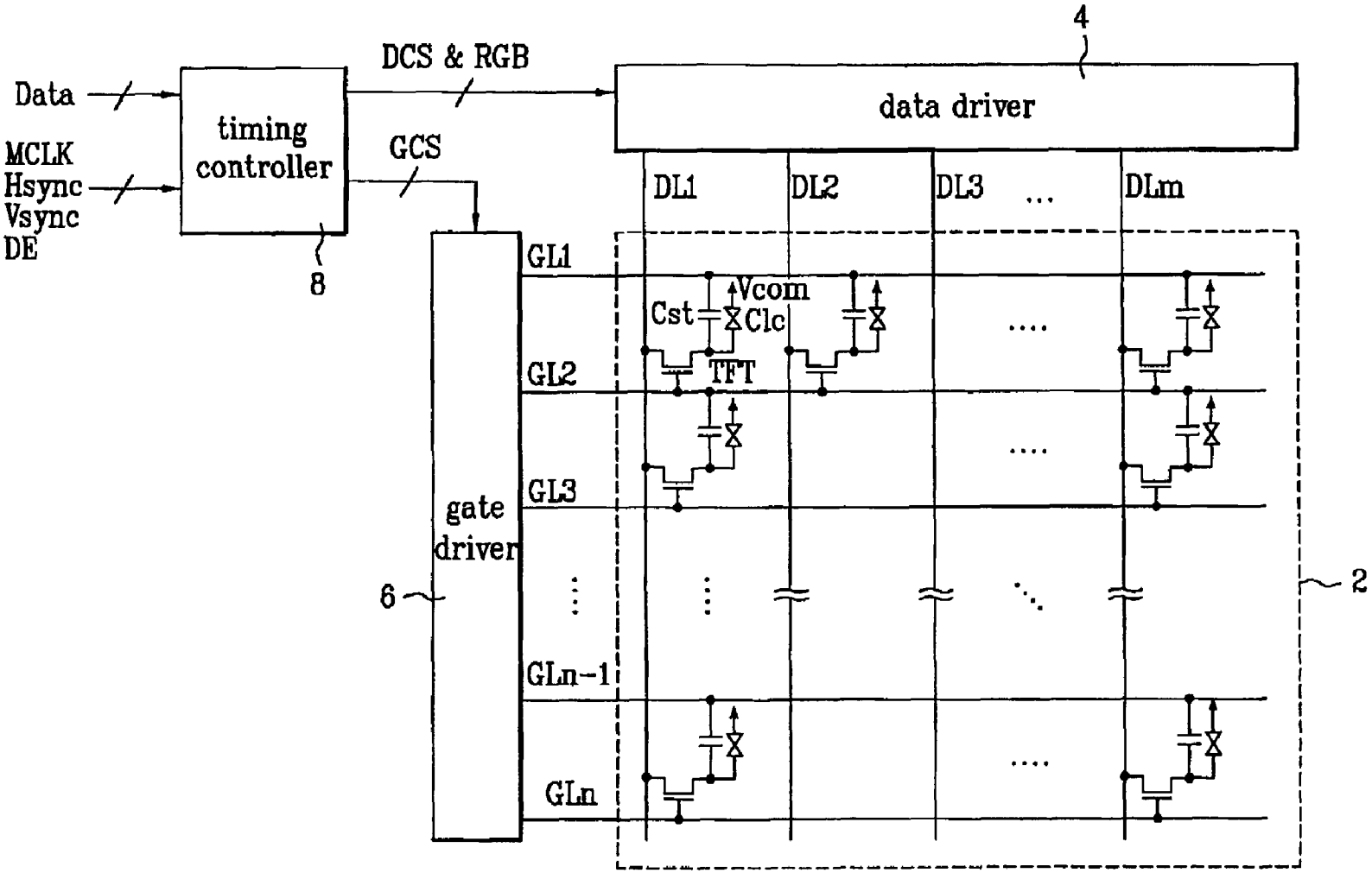
FIG. 1 Related Art
FIG. 1 shows a schematic diagram of an apparatus for driving an LCD according to the related art.
Figure 2:
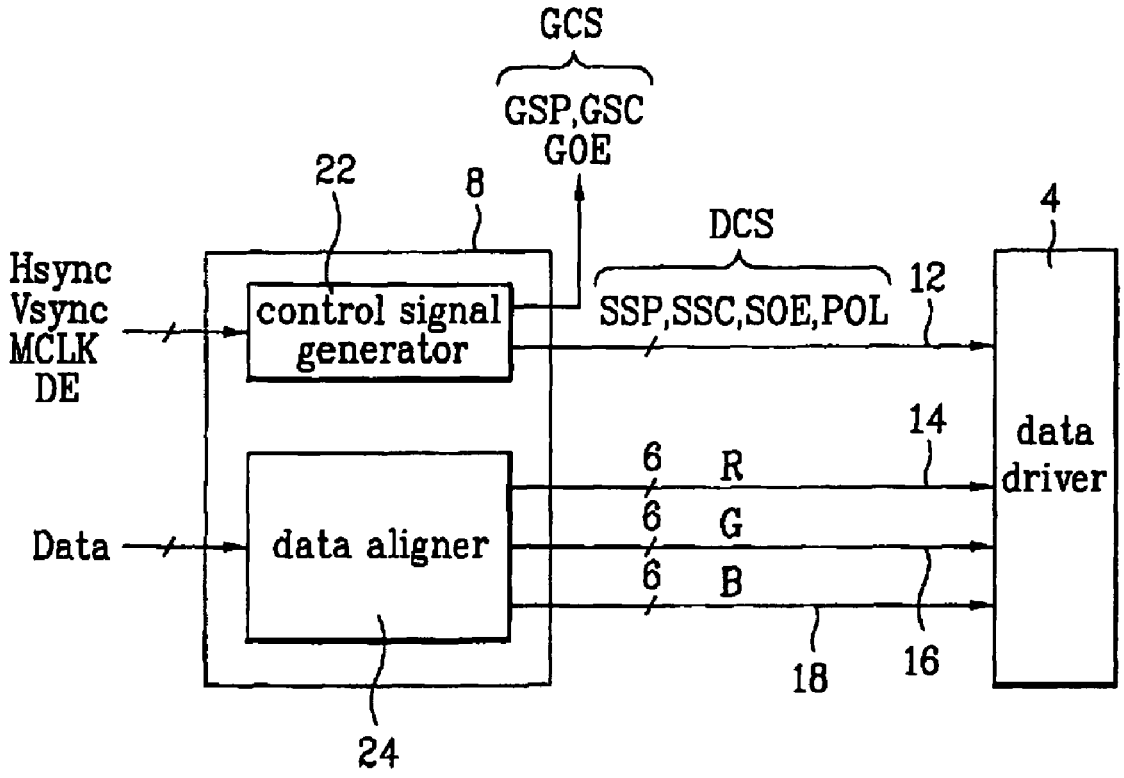
FIG. 2 Related Art
FIG. 2 is a schematic diagram illustrating a data transmission bus between a timing controller and a data driver in the related art apparatus of FIG. 1.
Figure 3:
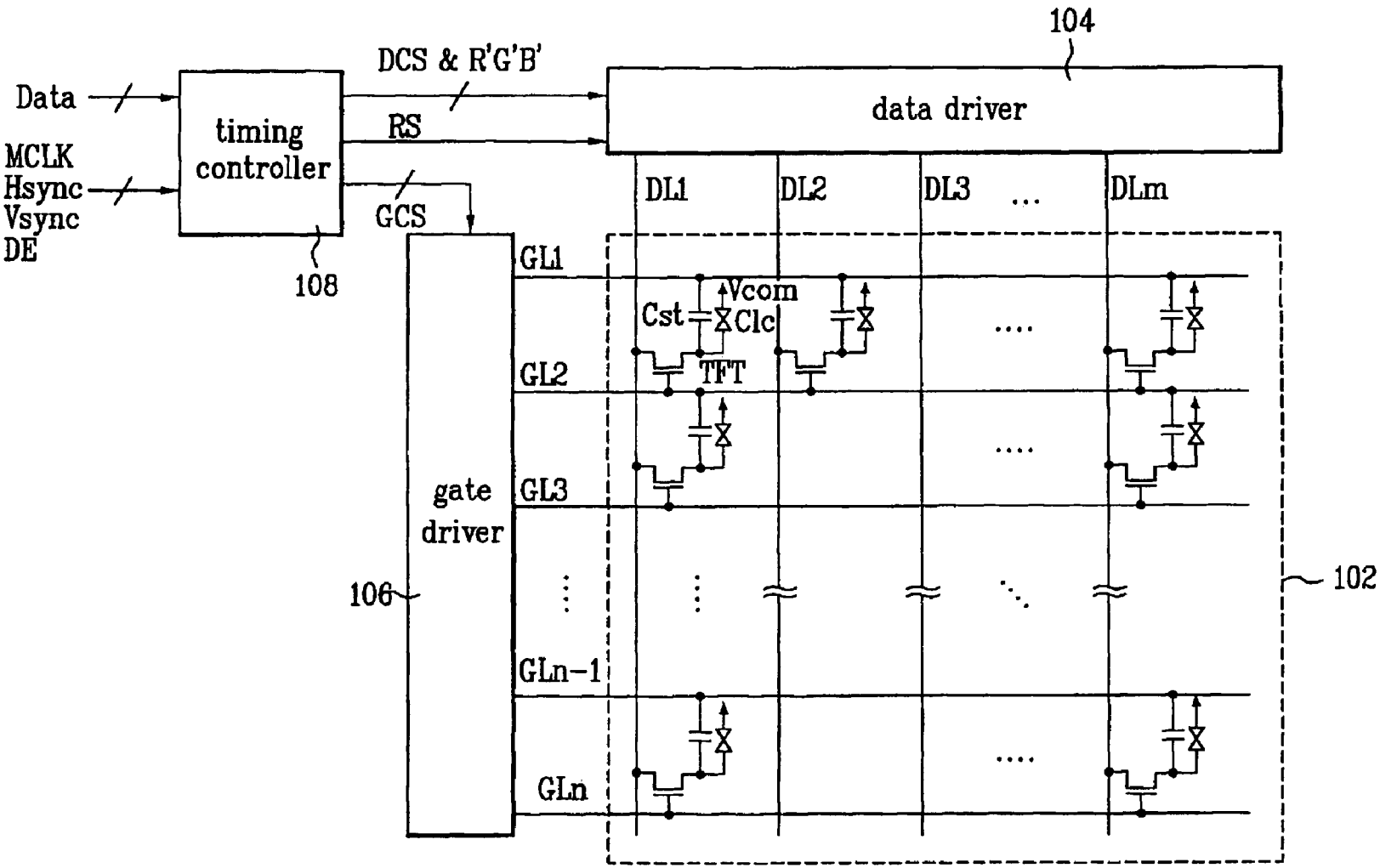
FIG. 3 shows a schematic diagram of an exemplary apparatus for driving an LCD according to an embodiment of the present invention.

FIG. 3 shows a schematic diagram of an exemplary apparatus for driving an LCD according to an embodiment of the present invention. Referring to FIG. 3, the apparatus for driving an LCD includes an image display unit 102 including liquid crystal cells formed in respective pixel regions defined by crossings of first to n-th gate lines GL1 to GLn and first to m-th data lines DL1 to DLm, a timing controller 108 converting externally provided N-bit source Data, where N is a positive integer, into (N−1)-bit R'G'B' data and transmitting a restoring signal RS for restoring the (N−1)-bit R'G'B' data to an N-bit data, a gate driver 106 supplying scan pulses to the gate lines GL1 to GLn under the control of the timing controller 108, and a data driver 104 restoring the (N−1)-bit R'G'B' data transmitted from the timing controller 108 to their original N-bit RGB data in response to the restoring signal RS and converting the restored RGB data into analog video signals under the control of the timing controller 108 to supply the analog video data to the data lines DL1 to DLm.

The image display unit 102 includes a transistor array substrate (not shown), a color filter array substrate (not shown), a spacer (not shown), and a liquid crystal (not shown). The transistor array substrate and the color filter array substrate face each and are bonded to each other. The spacer maintains a uniform cell gap between the two substrates. The liquid crystal is filled in the cell gap area between the two substrates.

The image display unit 102 includes a TFT formed in each of the pixel regions defined by crossings of the gate lines GL1 to GLn and the data lines DL1 to DLm. The TFT is electrically connected to a corresponding liquid crystal cell in the respective pixel region. The TFT supplies the analog video signals from the data lines DL1 to DLm to the liquid crystal cell in response to the scan pulses from the gate lines GL1 to GLn. Each of the liquid crystal cells includes a common electrode (not shown) and a pixel electrode facing each other with the liquid crystal interposed between the pixel electrode and the common electrode and pixel electrodes. Thus, the liquid crystal cell is equivalent to a liquid crystal capacitor Clc. The liquid crystal cell also includes a storage capacitor Cst connected to a previous gate line to hold the analog video signals filled in the liquid crystal capacitor Clc until the next analog video signals are filled in the liquid crystal capacitor Clc.

The timing controller 108 aligns the externally provided N-bit source Data to be suitable for driving of the image display unit 102 and converts the aligned N-bit source RGB data into the (N−1)-bit source R'G'B' data to transmit the converted data to the data driver 104 along with the restoring signal RS for restoring the (N−1)-bit R'G'B' data to the N-bit data.

Also, the timing controller 108 generates data control signals DCS and gate control signals GCS using a main clock MCLK, a data enable signal DE, and horizontal and vertical synchronizing signals Hsync and Vsync, which are externally provided, to control each driving timing of the data driver 104 and the gate driver 106.

The gate driver 106 includes a shift register that sequentially generates scan pulses, i.e., gate high pulses in response to a gate start pulse and a gate shift clock as gate control signals GCS from the timing controller 108. The gate driver 106 sequentially supplies the gate high pulses to the gate lines GL of the image display unit 102 to turn on the TFT connected to the gate lines GL.

The data driver 104 restores the (N−1)-bit R'G'B' data transmitted from the timing controller 108 to their original N-bit RGB data in response to the restoring signal RS supplied by the timing controller 108 and converts the restored N-bit RGB data into the analog video signals in response to the data control signals DCS supplied by the timing controller 108. Also, during each horizontal period, the data driver 104 supplies to the data lines DL1 to DLm the analog video signals corresponding to one horizontal line, when the scan pulses are supplied to the gate lines GL1 to GLn. Thus, the data driver 104 selects a gamma voltage having a predetermined level depending on a gray level value of the restored N-bit RGB data and supplies the selected gamma voltage to the data lines DL1 to DLm. Then, the data driver 104 inverts the polarity of the analog video signals supplied to the data lines in response to a polarity control signal supplied from the timing controller 108.

Figure 4:
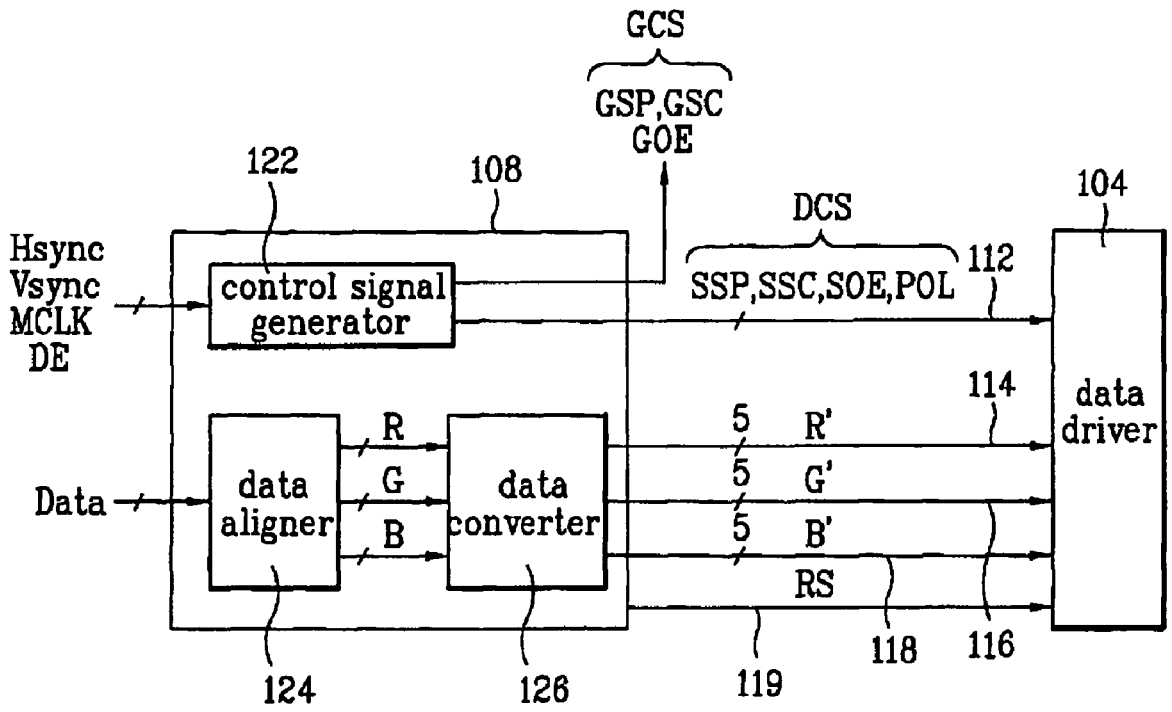
FIG. 4 is a schematic diagram illustrating an exemplary data transmission bus between a timing controller and a data driver in the LCD of FIG. 3.

FIG. 4 is a schematic diagram illustrating an exemplary data transmission bus between a timing controller and a data driver in the LCD of FIG. 3. Referring to FIG. 4, the timing controller 108 includes a control signal generator 122 generating the control signals DCS and GCS, a data aligner 124 aligning the N-bit source Data, and a data converter 126 inverting lower bit data excluding the most significant bit (MSB) in response to the MSB of the aligned N-bit RGB data to supply the inversed bit data to the data driver 104, converting the aligned N-bit RGB data into the (N−1)-bit R'G'B' data, and generating the restoring signal RS.

The control signal generator 122 generates the gate control signals GCS and the data control signals DCS(SSC, SSP, SOE and POL) using the main clock MCLK, the data enable signal DE, and the horizontal and vertical synchronizing signals Hsync and Vsync, which are externally provided. The gate control signals GCS are supplied to the gate driver 106 through respective transmission lines included in a gate control signal bus (not shown). The data control signals DCS are supplied to the data driver 104 through respective transmission lines included in a data control signal bus 112.

The data aligner 124 aligns the externally provided N-bit source Data for suitable bus transmission and supplies the aligned data to the data converter 126. The N-bit source data can be, foe example, 6-bit data. The N-bit data may be 6-bit data or greater.

The data converter 126 converts the aligned 6-bit RGB data into 5-bit R'G'B' data in response to the gray level of the aligned N-bit RGB data supplied from the data aligner 124 and supplies the converted data to the data driver 104. Also, the data converter 126 generates a restoring signal RS for restoring the converted 5-bit R'G'B' data to the 6-bit RGB data and supplies the restoring signal RS to the data driver 104.

Specifically, the data converter 126 compares the input 6-bit RGB data with reference 6-bit data set in a look-up table (not shown), or a memory unit, or a combination of a look-up-table with a memory unit, depending on a bit unit and maps the input 6-bit RGB data into the 5-bit R'G'B' data in accordance with the compared result. Thus, the data converter 126 can include a look-up table for mapping the 5-bit R'G'B' data corresponding to the compared result. The data converter 126 can also include a memory for storing the 5-bit R'G'B' data and transmitting the stored 5-bit R'G'B' data to the data driver 104 in response to an address signal corresponding to the compared result.

The input 6-bit RGB data are symmetrically inversed to each other based on 31 gray level (011111) and 32 gray level (100000). For example, 0 gray level (000000) is an inversed type of 63 gray level (111111), and 1 gray level (000001) is an inversed type of 62 gray level (111110). Similarly, 2 gray level (000010) to 31 gray level (011111) are inversed types of 61 gray level (111101) to 32 gray level (100000), respectively.

Therefore, the data converter 126 generates the 5-bit R'G'B' data and a restoring signal RS of a low level as shown in Table 2 and supplies the 5-bit R'G'B' data and the RS signal to the data driver 104 if the input 6-bit RGB data have a gray level value between 0 gray level (000000) to 31 gray level (011111).

TABLE 2

| Input data (RGB) | Output data (R'G'B') | Restoring signal (RS) |
|---|---|---|
| 000000 | 00000 | 0 |
| 000001 | 00001 | 0 |
| 000010 | 00010 | 0 |
| 000011 | 00011 | 0 |
| 000100 | 00100 | 0 |
| 000101 | 00101 | 0 |
| 000110 | 00110 | 0 |
| 000111 | 00111 | 0 |
| 001000 | 01000 | 0 |
| 001001 | 01001 | 0 |
| 001010 | 01010 | 0 |
| 001011 | 01011 | 0 |
| 001100 | 01100 | 0 |
| 001101 | 01101 | 0 |
| 001110 | 01110 | 0 |
| 001111 | 01111 | 0 |
| 010000 | 10000 | 0 |
| 010001 | 10001 | 0 |
| 010010 | 10010 | 0 |
| 010011 | 10011 | 0 |
| 010100 | 10100 | 0 |
| 010101 | 10101 | 0 |
| 010110 | 10110 | 0 |
| 010111 | 10111 | 0 |
| 011000 | 11000 | 0 |
| 011001 | 11001 | 0 |
| 011010 | 11010 | 0 |
| 011011 | 11011 | 0 |
| 011100 | 11100 | 0 |
| 011101 | 11101 | 0 |
| 011110 | 11110 | 0 |
| 011111 | 11111 | 0 |

As shown in Table 2, the input 6-bit RGB data of gray level 0 (000000) are mapped into the 5-bit R'G'B' data of gray level 0(00000) and the restoring signal RS of the low level and then transmitted to the data driver 104. Also, the input 6-bit RGB data of gray level 1 (000001) are mapped into the 5-bit R'G'B' data of gray level 1 (00001) and the restoring signal RS of the low level and then transmitted to the data driver 104. Likewise, the 6-bit RGB data of each of gray level 2 (000010) to gray level 31 (011111) are mapped into the 5-bit R'G'B' data of each of gray level 2 (00010) to gray level 31 (11111) and the restoring signal RS of the low level and then transmitted to the data driver 104.

The data converter 126 generates the 5-bit R'G'B' data and a restoring signal RS of a high level as shown in Table 3 and supplies the 5-bit R'G'B' data to the data driver 104 if the input 6-bit RGB data have a gray level value between gray level 32 (100000) to gray level 63 (111111).

TABLE 3

| Input data (RGB) | Output data (R'G'B') | Restoring signal (RS) |
|---|---|---|
| 111111 | 00000 | 1 |
| 111110 | 00001 | 1 |
| 111101 | 00010 | 1 |
| 111100 | 00011 | 1 |
| 111011 | 00100 | 1 |
| 111010 | 00101 | 1 |
| 111001 | 00110 | 1 |
| 111000 | 00111 | 1 |
| 110111 | 01000 | 1 |
| 110110 | 01001 | 1 |
| 110101 | 01010 | 1 |
| 110100 | 01011 | 1 |
| 110011 | 01100 | 1 |
| 110010 | 01101 | 1 |
| 110001 | 01110 | 1 |

TABLE 3-continued

| Input data (RGB) | Output data (R'G'B') | Restoring signal (RS) |
|---|---|---|
| 110000 | 01111 | 1 |
| 101111 | 10000 | 1 |
| 101110 | 10001 | 1 |
| 101101 | 10010 | 1 |
| 101100 | 10011 | 1 |
| 101011 | 10100 | 1 |
| 101010 | 10101 | 1 |
| 101001 | 10110 | 1 |
| 101000 | 10111 | 1 |
| 100111 | 11000 | 1 |
| 100110 | 11001 | 1 |
| 100101 | 11010 | 1 |
| 100100 | 11011 | 1 |
| 100011 | 11100 | 1 |
| 100010 | 11101 | 1 |
| 100001 | 11110 | 1 |
| 100000 | 11111 | 1 |

As shown in Table 3, the input 6-bit RGB data of gray level 32 (100000) are mapped into the 5-bit R'G'B' data of gray level 31 (11111) and the restoring signal RS of the high level and then transmitted to the data driver 104. Also, the input 6-bit RGB data of gray level 33 (100001) are mapped into the 5-bit R'G'B' data of gray level 30 (11110) and the restoring signal RS of the high level and then transmitted to the data driver 104. Likewise, the 6-bit RGB data of each of gray level 34 (100010) to gray level 63 (111111) are mapped into the 5-bit R'G'B' data of each of gray level 29 (11101) to gray level 0 (00000) and the restoring signal RS of the high level and then transmitted to the data driver 104.

The data converter 126 generates the 5-bit R'G'B' converted data. Then, the data converter 126 transmits each of the 5-bit R', G' and B' converted data through five data transmission lines 114, 116 and 118, respectively, to the data driver 104 and concurrently transmits the restoring signal RS to the data driver 104 through one restoring signal transmission line 119.

Figure 5:
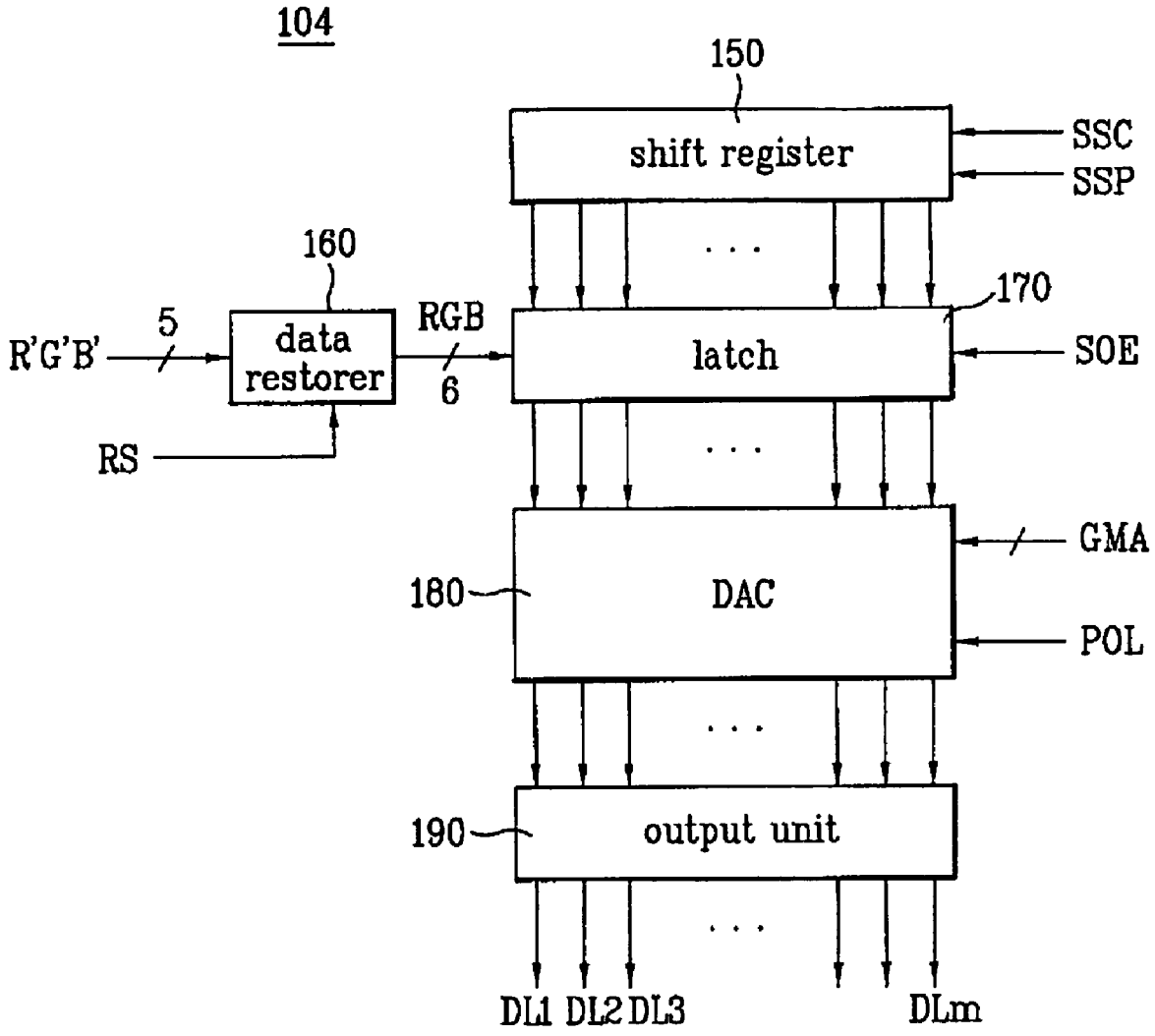
FIG. 5 is a block diagram illustrating the exemplary data driver shown in FIG. 3.

FIG. 5 is a block diagram illustrating the exemplary data driver shown in FIG. 3. Referring to FIG. 5 in connection with FIGS. 3 and 4, the data driver 104 includes a shift register 150 sequentially generating sampling signals, a data restorer 160 restoring the R'G'B' data converted from the data converter 126 to their original RGB data in response to the restoring signal RS from the data converter 126, a latch 170 latching the RGB data restored from the data restorer 160 in response to the sampling signals, a digital-to-analog converter (DAC) 180 selecting one of a plurality of gamma voltages GMA in response to the latched RGB data to generate the analog video signals, and an output unit 190 buffering the analog video signals to be supplied to the data lines.

The shift register 150 sequentially generates the sampling signals using the source start pulse (SSP) and the source shift clock (SSC) received as data control signals from the timing controller 108. The shift register 150 supplies the generated sampling signals to the latch 170.

The data restorer 160 restores the 5-bit R'G'B' data transmitted from the data converter 126 through the data transmission lines 114, 116, and 118 to the 6-bit RGB data in response to the restoring signal RS transmitted from the data converter 126 through the restoring signal transmission line 119. Then, The data restorer 160 supplies the restored data to the latch 170.

Specifically, depending on a bit value, the data restorer 160 compares the 5-bit R'G'B' data transmitted from the data converter 126 through the data transmission lines 114, 116 and 118 with a reference 5-bit data set in a look-up table or memory (not shown) and restores the converted 5-bit R'G'B' data to their original data values, i.e., the 6-bit RGB data in response to the compared result. Then, if the data restorer 160 includes a look-up table, the 6-bit RGB data are mapped in the look-up table to correspond to the compared result. In the alternative, if the data restorer 160 includes a memory unit, the memory unit transmits the 6-bit RGB data stored in its corresponding address to the latch 170 in response to an address signal corresponding to the compared result. Therefore, the data restorer 160 restores the 5-bit R'G'B' data to the 6-bit RGB data as shown in Table 4 and supplies the restored values to the latch 170 if the restoring signal RS has a low level.

TABLE 4

| Restoring signal (RS) | Input data (R'G'B') | Restored data (RGB) |
|---|---|---|
| 0 | 00000 | 000000 |
| 0 | 00001 | 000001 |
| 0 | 00010 | 000010 |
| 0 | 00011 | 000011 |
| 0 | 00100 | 000100 |
| 0 | 00101 | 000101 |
| 0 | 00110 | 000110 |
| 0 | 00111 | 000111 |
| 0 | 01000 | 001000 |
| 0 | 01001 | 001001 |
| 0 | 01010 | 001010 |
| 0 | 01011 | 001011 |
| 0 | 01100 | 001100 |
| 0 | 01101 | 001101 |
| 0 | 01110 | 001110 |
| 0 | 01111 | 001111 |
| 0 | 10000 | 010000 |
| 0 | 10001 | 010001 |
| 0 | 10010 | 010010 |
| 0 | 10011 | 010011 |
| 0 | 10100 | 010100 |
| 0 | 10101 | 010101 |
| 0 | 10110 | 010110 |
| 0 | 10111 | 010111 |
| 0 | 11000 | 011000 |
| 0 | 11001 | 011001 |
| 0 | 11010 | 011010 |
| 0 | 11011 | 011011 |
| 0 | 11100 | 011100 |
| 0 | 11101 | 011101 |
| 0 | 11110 | 011110 |
| 0 | 11111 | 011111 |

As shown in Table 4, the 5-bit R'G'B' data of gray level 0 (00000) are restored to the 6-bit RGB data of gray level 0 (000000) in response to the restoring signal RS of the low level and then transmitted to the latch 170. Also, the 5-bit R'G'B' data of gray level 1 (00001) are restored to the 6-bit RGB data of gray level 1 (000001) and then transmitted to the latch. Likewise, the 5-bit R'G'B' data of each of gray level 2 (00010) to gray level 31 (11111) are restored to the 6-bit RGB data of each of gray level 2 (000010) to gray level 31 (011111) and then transmitted to the latch 170.

The data restorer 160 restores the converted 5-bit R'G'B' data to the 6-bit RGB data as shown in Table 5 and supplies the restored 6-bit RGB data to the latch 170 if the restoring signal RS has a high level.

TABLE 5

| Restoring signal (RS) | Input data (R'G'B') | Restored data (RGB) |
|---|---|---|
| 1 | 00000 | 111111 |
| 1 | 00001 | 111110 |
| 1 | 00010 | 111101 |
| 1 | 00011 | 111100 |
| 1 | 00100 | 111011 |
| 1 | 00101 | 111010 |

TABLE 5-continued

| Restoring signal (RS) | Input data (R'G'B') | Restored data (RGB) |
|---|---|---|
| 1 | 00110 | 111001 |
| 1 | 00111 | 111000 |
| 1 | 01000 | 110111 |
| 1 | 01001 | 110110 |
| 1 | 01010 | 110101 |
| 1 | 01011 | 110100 |
| 1 | 01100 | 110011 |
| 1 | 01101 | 110010 |
| 1 | 01110 | 110001 |
| 1 | 01111 | 110000 |
| 1 | 10000 | 101111 |
| 1 | 10001 | 101110 |
| 1 | 10010 | 101101 |
| 1 | 10011 | 101100 |
| 1 | 10100 | 101011 |
| 1 | 10101 | 101010 |
| 1 | 10110 | 101001 |
| 1 | 10111 | 101000 |
| 1 | 11000 | 100111 |
| 1 | 11001 | 100110 |
| 1 | 11010 | 100101 |
| 1 | 11011 | 100100 |
| 1 | 11100 | 100011 |
| 1 | 11101 | 100010 |
| 1 | 11110 | 100001 |
| 1 | 11111 | 100000 |

As shown in Table 5, the 5-bit R'G'B' data of gray level 0 (00000) are restored to the 6-bit RGB data of gray level 63 (111111) in response to the restoring signal RS of the high level and then transmitted to the latch 170. Also, the 5-bit R'G'B' data of gray level 1 (00001) are restored to the 6-bit RGB data of gray level 62 (111110) in response to the restoring signal RS of the high level and then transmitted to the latch 170. Likewise, the 5-bit R'G'B' data of each of gray level 2 (00010) to gray level 31 (11111) are restored to the 6-bit RGB data of each of gray level 61 (111101) to gray level 32 (100000) and then transmitted to the latch 170.

The latch 170 latches the restored RGB data from the data restorer 160 for each horizontal line in response to the sampling signals from the shift register 150. The latch 170 supplies the latched RGB data of one horizontal line to the DAC 180 in response to the source output enable (SOE) signal provided as one of the data control signals DCS from the timing controller 108.

The DAC 180 converts the RGB data into analog video signals by selecting one of a plurality of gamma voltages GMA supplied from a gamma voltage generator (not shown) in response to the RGB data supplied from the latch 170, and supplies the converted analog video signals to the output unit 190. The output unit 190 amplifies the analog video signals considering a load of the data lines and supplies the amplified analog video signals to their corresponding data lines.

In embodiments of the present invention, input N-bit RGB data are converted into (N−1)-bit R'G'B' data and a restoring signal RS of 1 bit to reduce a number of data transitions during data transmission, thereby minimizing electromagnetic interference.

Figure 6:
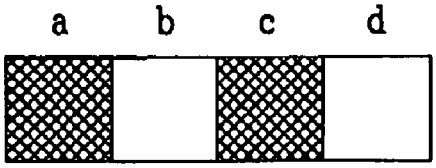
FIG. 6 illustrates an image pattern for comparing data transition of the related art with that of an embodiment of the present invention during data transmission.

For example, as shown in FIG. 6, if the 6-bit data are transmitted to repeatedly display black and white images in four unit pixels, the related art method for data transmission generates 18 data transitions 18 depending on each 6-bit data of red, green and blue, as shown in Table 6.

TABLE 6

| | a Data | b Data | c Data | d Data |
|---|---|---|---|---|
| R | 111111 | 000000 | 111111 | 000000 |
| G | 111111 | 000000 | 111111 | 000000 |
| B | 111111 | 000000 | 111111 | 000000 |

By contrast, the method for data transmission according to the preferred embodiment of the present invention generates data transition 9 times by converting the 6-bit RGB data to the 5-bit R'G'B' data and the restoring signal RS of 1 bit as shown in Table 7. In other words, no data transition occurs in the converted 5-bit R'G'B' data to be supplied to each of four unit pixels, and data transition occurs 9 times only in the restoring signal RS of 1 bit for restoring the converted 5-bit R'G'B' data into their original 6-bit RGB data.

TABLE 7

| | a Data | Restoring signal | b Data | Restoring signal | c Data | Restoring signal | d Data | Restoring signal |
|---|---|---|---|---|---|---|---|---|
| R | 000000 | 1 | 000000 | 0 | 000000 | 1 | 000000 | 0 |
| G | 000000 | 1 | 000000 | 0 | 000000 | 1 | 000000 | 0 |
| B | 000000 | 1 | 000000 | 0 | 000000 | 1 | 000000 | 0 |

Embodiments of the present invention can be used for a light-emitting display device having a light-emitting cell or a flat panel display device having a discharge cell, such as a plasma display panel, in addition to an LCD panel having a liquid crystal cell.

As described above, in embodiments of the present invention, an input N-bit data is converted into an (N−1)-bit data and a 1-bit restoring signal to reduce a number of data transitions and, thereby, minimize electromagnetic interference during data transmission. Also, it is possible to reduce high voltage level voltage swings due to decreasing data transmission. This could reduce power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for transmitting an image data within a display device, comprising:

a data converter converting an N-bit data, wherein N is a positive integer, into an (N−1)-bit data and concurrently generating a restoring signal; and a data restorer restoring the (N−1)-bit data to the N-bit data in accordance with a value of the restoring signal, wherein if the N-bit data has a gray level value less than half of a highest N-bit gray level value, the data converter converts the N-bit data into a first (N−1)-bit data and generates the restoring signal having a first logic level, wherein the first (N−1)-bit data is (N−1) bits excluding a most significant bit from the N-bit data, wherein if the N-bit data has a gray level value more than half of the highest N-bit gray level value, the data converter converts the N-bit data into a second (N−1)-bit data and generates the restoring signal having a second logic level, wherein the second (N−1)-bit data is inverted from (N−1) bits excluding the most significant bit from the N-bit data, wherein the data converter includes a look-up table or a memory unit for mapping the N-bit data into the (N−1)-bit data, and wherein the data restorer includes a look-up table and a memory unit for mapping the (N−1)-bit data into the N-bit data to restore the N-bit data.

2. The apparatus of claim 1, wherein the restoring signal corresponds to the most significant bit of the N-bit data.

3. An apparatus for driving an image display device, comprising:

an image display unit including pixel cells in each pixel region defined by crossings of a plurality of gate lines with a plurality of data lines;

a timing controller converting an externally provided N-bit data, wherein N is a positive integer, into an (N−1)-bit data and concurrently generating a restoring signal for restoring the (N−1)-bit data to the N-bit data;

a gate driver supplying scan pulses to the gate lines under the control of the timing controller; and a data driver restoring the (N−1)-bit data to the N-bit data in accordance with a logic level of the restoring signal, and converting the restored N-bit data into analog video signals under the control of the timing controller to supply the analog video signals to the data lines, wherein if the N-bit data has a gray level value less than half of a highest N-bit gray level value, the timing controller converts the N-bit data into a first (N−1)-bit data and generates the restoring signal having a first logic level, wherein the first (N−1)-bit data is (N−1) bits excluding a most significant bit from the N-bit data, wherein if the N-bit data has a gray level value more than half of the highest N-bit gray level value, the timing controller converts the N-bit data into a second (N−1)-bit data and generates the restoring signal having a second logic level, wherein the second (N−1)-bit data is inverted from (N−1) bits excluding the most significant bit from the N-bit data, wherein the timing controller includes a look-up table or a memory unit for mapping the N-bit data into the (N−1)-bit data, and wherein the data driver includes a look-up table and a memory unit for mapping the (N−1)-bit data into the N-bit data to restore the N-bit data.

4. The apparatus of claim 3, wherein the restoring signal corresponds to the most significant bit of the N-bit data.

5. A method for transmitting an image data within a display device, comprising:

converting an N-bit data, wherein N is a positive integer, into an (N−1)-bit data and concurrently generating a restoring signal for restoring the (N−1)-bit data to the N-bit data; and restoring the (N−1)-bit data to the N-bit data in accordance with the restoring signal, wherein if the N-bit data has a gray level value less than half of a highest N-bit gray level value, the N-bit data is converted into a first (N−1)-bit data and the restoring signal having a first logic level is generated, wherein the first (N−1)-bit data is (N−1) bits excluding a most significant bit from the N-bit data, wherein if the N-bit data has a gray level value more than half of the highest N-bit gray level value, the N-bit data is converted into a second (N−1)-bit data and the restoring signal having a second logic level is generated, wherein the second (N−1)-bit data is inverted from (N−1) bits excluding the most significant bit from the N-bit data, wherein the converting comprises mapping the N-bit data into the (N−1)-bit data using a look-up table or a memory unit, and wherein the restoring comprises mapping the (N−1)-bit data into the N-bit data using a look-up table or a memory unit.

6. The method of claim 5, wherein the restoring signal corresponds to the most significant bit of the N-bit data.

7. A method for driving an image display device, which includes an image display unit including pixel cells in each pixel region defined by crossings of a plurality of gate lines with a plurality of data lines, the method comprising:

converting an externally provided N-bit data, N is a positive integer, into an (N−1)-bit data and concurrently generating a restoring signal for restoring the (N−1)-bit data to the N-bit data;

restoring the (N−1)-bit data to the N-bit data in response to the restoring signal;

supplying scan pulses to the gate lines; and converting the restored data into analog video signals to synchronize with the scan pulses and supplying the analog video signals to the data lines, wherein if the N-bit data has a gray level value less than half of a highest N-bit gray level value, the N-bit data is converted into a first (N−1)-bit data and the restoring signal having a first logic level is generated, wherein the first (N−1)-bit data is (N−1) bits excluding a most significant bit from the N-bit data, wherein if the N-bit data has a gray level value more than half of the highest N-bit gray level value, the N-bit data is converted into a second (N−1)-bit data and the restoring signal having a second logic level is generated, wherein the second (N−1)-bit data is inverted from (N−1) bits excluding the most significant bit from the N-bit data, wherein the converting comprises mapping the N-bit data into the (N−1)-bit data using a look-up table or a memory unit, and wherein the restoring comprises mapping the (N−1)-bit data into the N-bit data using a look-up table or a memory unit.

8. The method of claim 7, wherein the restoring signal corresponds to the most significant bit of the N-bit data.

* * * * *